US005101135A

United States Patent [19]

Oshima

[11] Patent Number: 5,101,135

[45] Date of Patent: Mar. 31, 1992

[54] SPARK PLUG FOR USE IN AN INTERNAL COMBUSTION ENGINE

[75] Inventor: Takafumi Oshima, Nagoya, Japan

[73] Assignee: NGK Spark Plug Co., Ltd., Nagoya, Japan

[21] Appl. No.: 578,158

[22] Filed: Sep. 6, 1990

[30] Foreign Application Priority Data

Sep. 14, 1989 [JP] Japan ..... 1-236861

[51] Int. Cl.[5] ..... H01T 13/20

[52] U.S. Cl. ..... 313/142; 313/11.5

[58] Field of Search ..... 313/141, 11.5, 142

[56] References Cited

U.S. PATENT DOCUMENTS

| | | | |
|---|---|---|---|
| 2,391,456 | 12/1945 | Hensel | 313/11.5 |
| 2,391,457 | 12/1945 | Carlson | 313/11.5 |
| 3,407,326 | 10/1968 | Romine | 313/141 |
| 3,984,717 | 10/1976 | Romanowski et al. | 313/141 |
| 4,439,708 | 3/1984 | Hattori et al. | 313/142 X |
| 4,488,081 | 12/1984 | Kondo et al. | 313/141 |
| 4,581,558 | 4/1986 | Takamura et al. | 313/141 |
| 4,910,428 | 3/1990 | Strumbos | 313/141 |

FOREIGN PATENT DOCUMENTS 0163782 9/1984 Japan ..... 313/141

*Primary Examiner*—Palmer C. DeMeo

*Attorney, Agent, or Firm*—Sughrue, Mion, Zinn Macpeak & Seas

[57] ABSTRACT

In a spark plug for use in an internal combustion engine, a nickel-alloy based center electrode is placed into a metallic shell through a tubular insulator. An outer electrode is depended from the metallic shell to from a spark gap with a front end of the center electrode. A spark portion is secured to the center electrode, and comprising a nickel-alloy based tubular clad tip and an iridium or iridium-alloy based inner core fit into the clad tip. A rear open end of the clad tip is welded to a front end surface of the center electrode. A dimensional relationship among the center electrode, the inner core and the clad tip being determined as follows: $A \leqq 1.5mm$, $0.2mm \leqq B \leqq 0.8mm$, $C \geqq 0.1mm$, where A is an outer diameter of the front end surface of the center electrode, B is an outer diameter of the inner core, while C is an outer diameter of the tubular clad tip.

6 Claims, 3 Drawing Sheets

SPARK PLUG FOR USE IN AN INTERNAL COMBUSTION ENGINE

BACKGROUND OF THE INVENTION

1. Field of the Invention

This invention relates to a spark plug for use in an internal combustion engine in which a spark portion is discretely provided at a front end surface of a center electrode in registration with an outer electrode.

2. Description of Prior Art

With high output performance of an internal combustion engine, it has been required to ensure a positive ignition of a fuel, and at the same time, ensuring a spark-erosion resistant property for a spark plug. In order to comply with this requirement, an iridium-alloy based or platinum-alloy based tip is secured to a front end surface of a nickel-based center electrode by means of welding.

The tip enables positive ignition of the fuel and has good spark-erosion resistant properties. However, a thermal expansional difference between the tip and the center electrode causes results in a thermal stress therebetween, causing the tip to fall off the center electrode damaging a cylinder of the engine as the tip is alternately exposed to a heated and cooled environment while the engine is running.

Therefore, it is an object of the invention to provide a spark plug for use in an internal combustion engine which is capable of ensuring a positive ignition of a fuel and a spark-erosion resistant property at a high revolution range, and at the same time, securely preventing the spark portion from falling off the center electrode so as to contribute to an extended period of service life.

SUMMARY OF THE INVENTION

According to the invention, there is provided a spark plug for use in an internal combustion engine which includes a metallic shell into which a nickel-alloy based center electrode is placed through a tubular insulator, and having an outer electrode extending from the metallic shell to from a spark gap between the outer electrode and a front end of the center electrode; a spark portion secured to the center electrode, and comprising a nickel-alloy based tubular clad tip and an iridium or iridium-alloy based inner core tightly fit into the clad tip, a rear open end of the clad tip being welded to a front end surface of the center electrode; a dimensional relationship among the center electrode, the inner core and the clad tip being determined as follows: $A \leqq 1.5$ mm, 0.2 mm $\leqq B \leqq 0.8$ mm, $C \geqq 0.1$ mm where A is an outer diameter of the front end surface of the center electrode, B is an outer diameter of the inner core, while C is the thickness of the tubular clad tip. Thus, it possible to prevent a thermal stress between the spark portion and the center electrode so as to prevent the spark portion from falling off the center electrode which otherwise would damage on a cylinder of the engine.

An iridium-based alloy of the inner core includes an additive component of less than 70 wt %, and having a coefficient of linear thermal expansion ranging to $7.0 \times 10^{-6}$ to $13.0 \times 10^{-6}$ with a melting point of more than 1900 degrees Celsius.

This enables to impart the inner core with a spark-erosion resistant property.

Further, at least one intermediate tubular layer is provided between the tubular clad tip and the inner core, the intermediate tubular layer being made of metallic material, and having a thickness of more than 50 μm, a coefficient of linear thermal expansion of which falls between that of the inner core and that of the tubular clad tip.

The intermediate tubular layer makes it possible to reduce a thermal stress between the inner core and the clad tip when the spark portion is exposed to a high temperature environment.

Furthermore, the coefficient of linear thermal expansion of the intermediate tubular layer is adapted to gradually increase in a direction from the inner core to the tubular clad tip.

These and other objects and advantages of the invention will be apparent upon reference to the following specification, attendant claims and drawings.

DETAILED DESCRIPTION OF THE EMBODIMENTS

Figure 1:
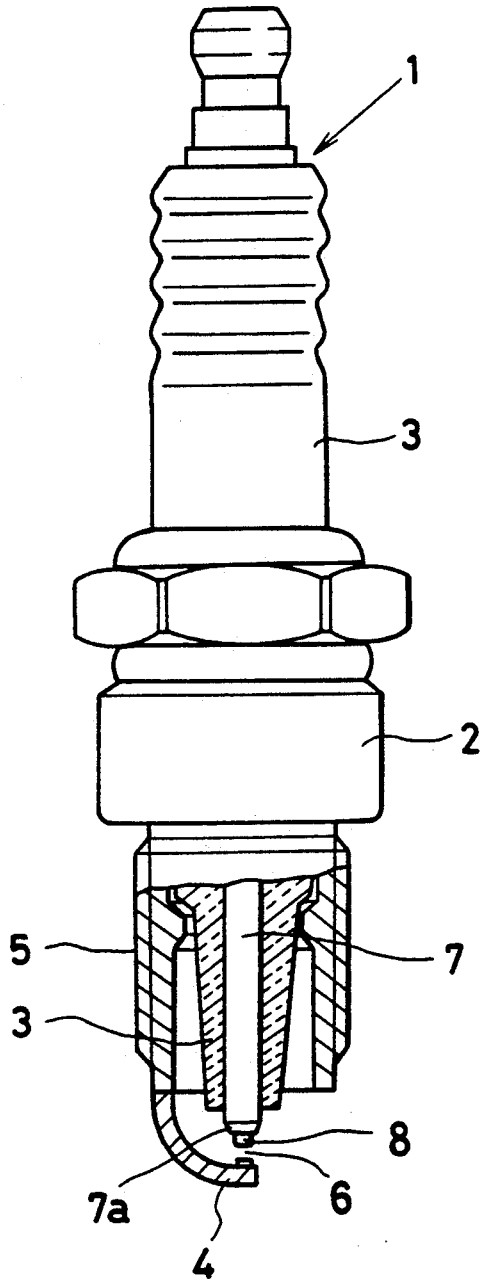
FIG. 1 is a plan view of a spark plug for use in an internal combustion engine according to a first embodiment of the invention, but partly sectioned.
Figure 2:
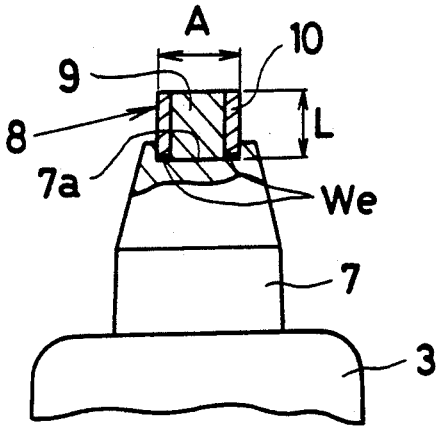
FIG. 2 a longitudinal cross sectional view of a spark portion around a center electrode according to a first embodiment of the invention, where the center electrode is almost broken away.

Referring to FIG. 1 in which a first embodiment of the invention is shown, numeral 1 designates a spark plug for use in an internal combustion engine. The spark plug 1 has a metallic shell 2 having a male thread portion 5 for attaching to a cylinder head of the internal combustion engine. From a front end of the metallic shell 2, an outer electrode 4 is depended substantially in a manner of an arcuate configuration. Within the metallic shell, a tubular insulator 3 is concentrically placed into which a nickel-alloy based center electrode 7 is concentrically provided. A front end surface 7*a* of the center electrode 7 is located to be in registration with the outer electrode 4 to form a spark gap 6 therebetween. To the front end surface 7*a* of the center electrode 7, a spark portion 8 is secured which, as shown in FIG. 2, consists of a tubular clad tip 10 and an inner core 9 interfit into the clad tip 10 by means of cold extrusion, for example.

It is appreciated that instead of the cold extrusion serration, roulette, shrinkage fit and press fit may be used.

In the meanwhile, an axial length (L) of the inner core 9 is determined to be generally equal to that of the clad tip 10 to make a front end of the core 9 flush with that of the clad tip 10. The clad tip 10 is made of a nickel-based alloy which is the same material as the center electrode 7. A rear open end 10*a* of the clad tip 10 is rigidly secured to the front end surface 7*a* of the center electrode 7 by means of an electrical weld as designated by a denotation (We).

Figure 3A:
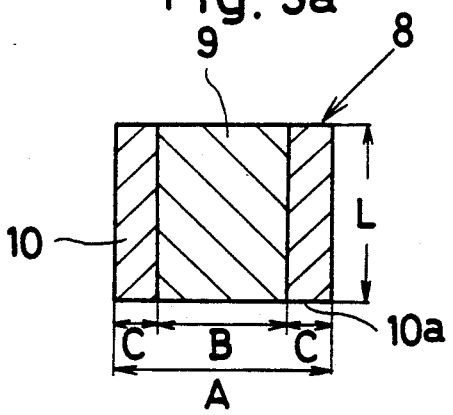
FIG. 3*a* is an enlarged longitudinal cross sectional view of the spark portion.
Figure 3B:
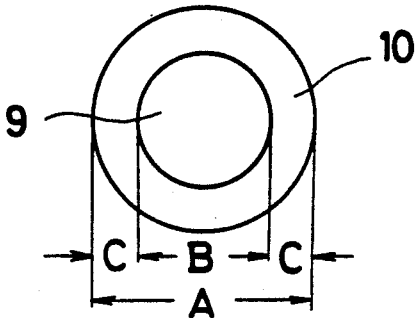
FIG. 3*b* is an enlarged upper plan view of the spark portion.

On the other hand the inner core 9 is made of iridium or iridium-based alloy such as 75 wt % Ir - 25 wt % Pt or 75 wt % Ir - 25 wt % Ni with Pt and Ni as an additive component. In this instance, linear thermal expansions of nickel, iridium and platinum-iridium based alloy is in turn $13.5\times10^{-6}$, $6.8\times10^{-6}$ and $9.3\times10^{-6}$ while the additive component is determined to include less than 70 wt %. Then, the inner core 9 is arranged to have a coefficient of a linear thermal expansion ranging from $7.0\times10^{-6}$ to $13.0\times10^{-6}$ with a melting point as 1900 degrees Celsius. As shown in FIGS. 3*a*, 3*b*, a dimensional relationship among the center electrode 7, the inner core 9 and the clad tip 10 is determined as follows: $A\leqq1.5$ mm, 0.2 mm$\leqq B\leqq0.8$ mm, $C\geqq0.1$ mm, where a denotation (A) is an outer diameter of the front end surface 7*a* of the center electrode 7, a denotation (B) is an outer diameter of the inner core 9, while a denotation (C) is a thickness of the tubular clad tip 10.

In addtion, the nickel-based clad tip 10 is welded to the nickel based center electrode 7, the dimensional determination among the center electrode 7, the inner core 9 and the clad tip 10 is such as to prevent the clad tip 10 from falling off the center electrode 7 with minimum stress between the clad tip 10 and the center electrode 7 when the spark portion 8 is exposed to a high temperature environment when running the engine for a long period of hours.

With the melting point of the iridium-based inner core 9 greater than 1900 degrees Celsius, it is possible to impart the inner core 9 of the spark portion 8 with a spark-corosion resistant property even when the spark portion 8 is exposed to a high temperature environment due to a long mileage's running with a high revolution range.

Figure 4:
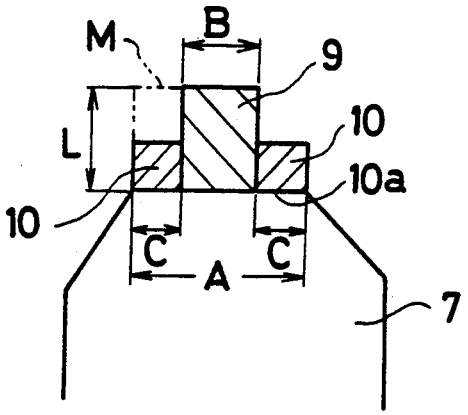
FIG. 4 is a view similar to FIG. 2 according to a second embodiment of the invention.

A second embodiment of the invention is described hereinafter in reference to FIG. 4. In the second embodiment of the invention, like reference numerals identical to FIG. 3*a* are commonly used in FIG. 4. In this instance, a front portion of the clad tip 10 is cut by a length of (M), so that the front end of the inner core 9 can somewhat extend beyond that of the clad tip 10 to be exposed outside. The extended inner core 9 makes it possible to reduce an amount of spark erosion of the spark portion 8 while maintaining efficient fuel ignition. With the reduced amount of the spark erosion, the inner core 9 becomes acceptable as a product when the inner core 9 is as thin as 0.2 mm to 0.8 mm in diameter (B).

Figure 5A:
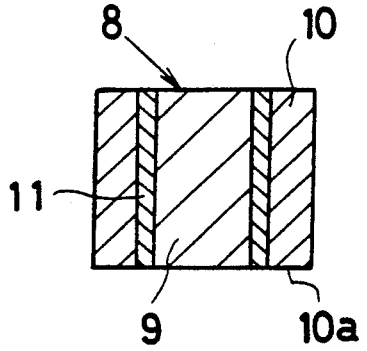
FIG. 5*a* is a view similar to FIG. 3*a* according to a second embodiment of the invention.
Figure 5B:
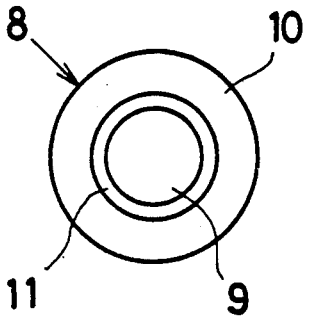
FIG. 5*b* is a view similar to FIG. 3 according to a second embodiment of the invention.

A third embodiment of the invention is described hereinafter in reference to FIGS. 5*a*, 5*b*. In the third embodiment of the invention, like reference numerals identical to FIGS. 3*a*, 3*b* are commonly used in FIGS. 5*a*, 5*b*. In this instance, one piece of an intermediate tubular layer 11 is provided between the inner core 9 and the clad tip 10. The intermediate tubular layer 11 is made of an iridium-based alloy, a linear thermal expansion of which is predetermined to fall between that of the inner core 9 and that of the clad tip 10. For this reason, the linear thermal expansion of the intermediate tubular layer 11 fall on $7.0\times10^{-6}$ at a minimum, and $13.0\times10^{-6}$ at a maximum.

The intermediate tubular layer 11 makes it possible to effectively reduce thermal stress between the inner core 9 and of the clad tip 10 when the spark portion 8 is exposed to a high temperature environment due to a long period of running hours with a high revolution range.

Figure 6:
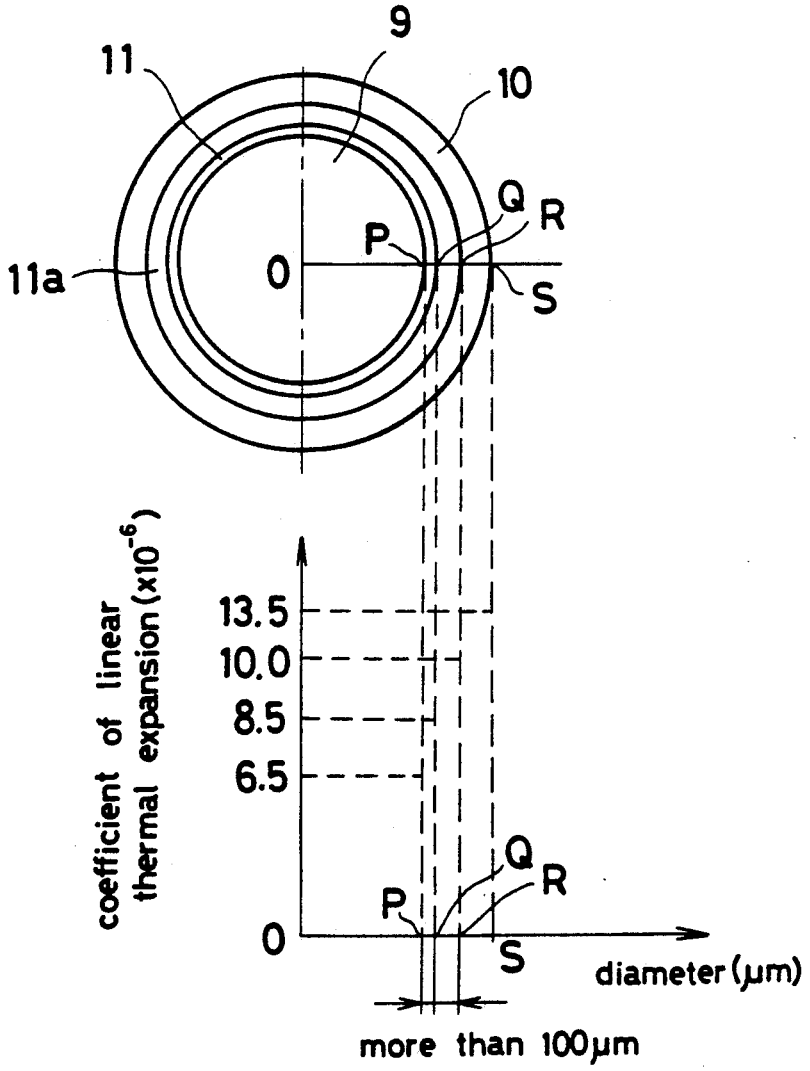
FIG. 6 is an enlarged upper view of a modified spark portion with an indication between coefficients of linear thermal expantion and diameters of intermediate layers.

FIG. 6 is a modified form of the third embodiment of the invention including two pieces of intermediate tubular layers. Another intermediate tubular layer 11*a* is provided between the intermediate tubular layer 11 and the clad tip 10. A linear thermal expansion of the intermediate tubular layer 11*a* is predetermined to be greater than that of the intermediate tubular layer 11, but smaller than that of the clad tip 10. It is noted that the intermediate tubular layer may be made of Pt-Ir alloy, Pt-Ni alloy or Ir-Ni alloy.

In this instance, as shown in FIG. 6, thicknesses of the intermediate tubular layers 11, 11*a* are determined to be 100 μm each, corresponding to a distance between points P (Q) and Q (R) with points between (R) and (S) as a dimension (C) as a thickness of the clad tip 10.

When more than two pieces of intermediate tubular layers are provided, it is arranged that a linear thermal expansion of the intermediate tubular layer falls on between that of the inner core 9 and that of the clad tip 10, and gradually increases as approaching from the inner core 9 toward the clad tip 10.

As understood from the foregoing description, the spark portion 8 consists of the tubular clad tip 10 and the inner core 9 interfit into the clad tip 10, and the tip 10 is welded to the center electrode 7. As a result, metals of the same nickel-based alloy is mutually welded when the clad tip 10 is secured to the center electrode 7. Thus leads to ensuring sufficiently enough securement between the clad tip 10 and center electrode 7 to prevent the clad tip 10 from falling off the center electrode 7 when the spark portion is exposed to a high temperature environment.

The intermediate tubular layer makes it possible to serve as a thermal stress relief member between the inner core 9 and the clad tip 10 when the spark portion is exposed to a high temperature environment. Therefore, even if a thermal stress is set up due to a difference of the thermal expansion between the inner core 9 and the clad tip 10, the thermal strees is effectively reduced to prevent the spark portion 8 from falling off the center electrode 7 so as to sufficiently protect the cylinder against a damage.

Further, with the melting point of the iridium-based inner core 9 as more than 1900 degrees Celsius, it is, of course, possible to impart the inner core 9 with a spark-corosion resistant property even when the spark portion 8 is exposed to a high temperature environment due to a long mileage's running with a high revolution range.

As many widely different embodiments of the present invention may be made without departing from the spirit and scope thereof, it is to be understood that the present invention is not limited to the specific embodiments, except as defined in the appended claims.

What is claimed is:

1. In a spark plug for use in an internal combustion engine which spark plug includes a metallic shell into which a nickel-alloy based center electrode is placed through a tubular insulator, and having an outer electrode extending from the metallic shell to from a spark gap between the outer electrode and a front end of the center electrode;

a spark portion provided to be secured to the center electrode, and comprising a nickel-alloy based tubular clad tip and an iridium or iridium-alloy based inner core interfit into the clad tip, said clad tip having a front surface and a rear surface, the rear surface of the clad tip being welded to a front end surface of the center electrode;

a dimensional relationship among the center electrode, the inner core and the clad tip being determined as follows:

$$A \leqq 1.5 \text{ mm}, 0.2 \text{ mm} \leqq B \leqq 8 \text{ mm}, C \geqq 0.1 \text{ mm}$$

where A is an outer diameter of the front end surface of the center electrode, B is an outer diameter of the inner core, while C is the thickness of the tubular clad tip.

2. In a spark plug as recited in claim 1, wherein an iridium-based alloy of the inner core includes an additive component of less than 70 wt %, and having a coefficient of linear thermal expansion ranging to $7.0 \times 10^{-6}$ to $13.0 \times 10^{-6}$ with a melting point more than 1900 degrees Celsius.

3. In a spark plug as recited in claim 2, wherein the additive component of the iridium alloy is platinum or nickel.

4. In a spark plug as recited in claim 1, wherein at least one intermediate tubular layer is provided between the tubular clad tip and the inner core, the intermediate tubular layer being made of metallic material, and having a thickness of more than 50 μm, a coefficient of linear thermal expansion of which falls inbetween that of the inner core and that of the tubular clad tip.

5. In a spark plug as recited in claim 4, wherein the coefficient of linear thermal expansion of the intermediate tubular layer is adapted to gradually increase in a direction from the inner core to the tubular clad tip.

6. In a spark plug as recited in claim 1, 2, 4 or 5, wherein an axial length of the core is determined to be somewhat greater than that of the tubular clad tip, so that a front end of the inner core extends beyond that of the tubular clad tip to be exposed outside.

* * * * *